US011486608B2

(12) United States Patent
Nakamura

(10) Patent No.: US 11,486,608 B2
(45) Date of Patent: Nov. 1, 2022

(54) HEAT EXCHANGING DEVICE

(71) Applicant: PORTA-PARK, INC., Tokyo (JP)

(72) Inventor: Takuju Nakamura, Tokyo (JP)

(73) Assignee: PORTA-PARK, INC., Tokyo (JP)

( * ) Notice: Subject to any disclaimer, the term of this patent is extended or adjusted under 35 U.S.C. 154(b) by 509 days.

(21) Appl. No.: 16/549,031

(22) Filed: Aug. 23, 2019

(65) Prior Publication Data

US 2019/0376729 A1 Dec. 12, 2019

Related U.S. Application Data

(63) Continuation of application No. PCT/JP2017/007354, filed on Feb. 27, 2017.

(51) Int. Cl.

| | |
|---|---|
| ***F25B 15/02*** | (2006.01) |
| ***F25B 27/00*** | (2006.01) |
| ***F25B 49/04*** | (2006.01) |
| *F25B 15/04* | (2006.01) |
| *F25B 15/06* | (2006.01) |

(52) U.S. Cl.

CPC ..... *F25B 15/02* (2013.01); *F25B 27/007* (2013.01); *F25B 49/043* (2013.01); *F25B 15/04* (2013.01); *F25B 15/06* (2013.01)

(58) Field of Classification Search

CPC ..... F25B 27/007; F25B 15/02; F25B 15/06; F25B 49/043

See application file for complete search history.

(56) References Cited

U.S. PATENT DOCUMENTS

| | | | | |
|---|---|---|---|---|
| 5,752,388 | A | 5/1998 | Hoshino et al. | |
| 2013/0291574 | A1* | 11/2013 | Athalye | F25B 17/08 62/101 |

FOREIGN PATENT DOCUMENTS

| | | | |
|---|---|---|---|
| CN | 101240925 | B | 3/2012 |
| JP | 2010-14328 | A | 1/2010 |
| JP | 2012-127574 | A | 7/2012 |
| JP | 2014-102054 | A | 6/2014 |
| JP | 2017-58119 | A | 3/2017 |

* cited by examiner

*Primary Examiner* — Brian M King

(74) *Attorney, Agent, or Firm* — Sughrue Mion, PLLC

(57) ABSTRACT

A heat exchanging device includes a regenerator that heats an absorbent by external energy and generates a vapor refrigerant by evaporating a refrigerant from the absorbent, a condenser that generates a liquid refrigerant by cooling and liquefying the vapor refrigerant, an evaporator that generates a vapor refrigerant by vaporizing the vapor refrigerant, an absorber that absorbs the liquid refrigerant into the absorbent, and first and second cover members arranged opposite to each other. The evaporator absorbs heat from a space on a second cover member side in a space between the first and second cover members through the second cover member. The absorber dissipates the heat from a space on a first cover member side in the space between the first and second cover members through the first cover member, and circulates the refrigerant and the absorbent.

10 Claims, 16 Drawing Sheets

HEAT EXCHANGING DEVICE

CROSS REFERENCE TO RELATED APPLICATIONS

This application is a continuation of PCT application No. PCT/JP17/007354, which was filed on Feb. 27, 2017, the contents of which are incorporated herein by reference.

BACKGROUND OF THE INVENTION

1. Field of the Invention

The present invention relates to a heat exchanging device configured in a compact manner.

2. Description of the Related Art

In the related art, a heat collector that converts solar light energy into heat energy has been known (for example, see JP-A-2012-127574). Further, an absorption refrigeration machine, which obtains a refrigerant from a heat source and cools circulating water or the like by heat of vaporization of the refrigerant, has been known (for example, see JP-A-2010-14328). An absorbent for absorbing the evaporated refrigerant circulates in the absorption refrigeration machine. Heat is generated in a process of absorbing the evaporated refrigerant and in a process of condensing the refrigerant regenerated and separated from the absorbent through boiling. Water and an aqueous lithium bromide solution, ammonia and water, or the like is generally used as a combination of the refrigerant and the absorbent. The lithium bromide type is much more efficient than the ammonia type. However, in general, it is necessary to perform an operation in a state in which the inside of the vessel is maintained at a vacuum of about 1/10 to 1/100 atm.

Further, a technology of heating the absorbent of the absorption refrigeration machine using solar heat collected with the heat collector has been proposed from the related art. For example, an apparatus, in which a heat collector is installed on the roof of a building, an absorption refrigeration machine is installed in a machine room on the ground floor or in the basement, and the collector and the absorption refrigeration machine are connected to each other through a heat medium pipe, has been practically applied as this type of technology.

However, in the above-described device, since the collector and the absorption refrigeration machine are installed in different places, it is necessary to independently provide a wall having pressure resistance to withstand the atmospheric pressure and airtightness to maintain a vacuum state. Therefore, an increase in the weight and an increase in costs of the entire device are caused. Further, since it is necessary to discharge heat generated in an absorption process and a condensation process for the refrigerant, in general, a water-cooled type in which cooling water is introduced is used. Further, it is necessary to transmit a cooling effect to a living space, a second refrigerant is introduced, and the absorption refrigeration machine and the living space are connected to each other using a second refrigerant tube. These facts are also factors that cause the increase in the weight and the increase in the costs.

The present invention has been made to solve the above-described problems, and an aspect of the present invention is to provide a heat exchanging device which can share a wall having pressure resistance and airtightness and can simultaneously realize an increase in the amount of heat dissipation or heat absorption and an increase in the amount of heat collection.

SUMMARY OF THE INVENTION

The present invention has the following configuration in order to solve the above-described problems.

(1) A heat exchanging device including: a regenerator that heats an absorbent by acquired external energy and generates a vapor refrigerant by evaporating a refrigerant from the absorbent; a condenser that generates a liquid refrigerant by cooling and liquefying the vapor refrigerant generated by the regenerator; an evaporator that generates a vapor refrigerant by vaporizing the liquid refrigerant generated by the condenser and cools an object by heat of vaporization; an absorber that absorbs the vapor refrigerant generated by the evaporator into the absorbent; a plate-shaped structure that has a first surface and a second surface extending two-dimensionally and arranged on a front side and a rear side thereof, respectively, and has a predetermined thickness; and a first cover member that is disposed apart from the first surface to cover the first surface and sets a first space between the first surface and the first cover member, in which the first space functions as at least one of the condenser and the absorber that dissipate heat from the first cover member and circulates the refrigerant and the absorbent.

(2) The heat exchanging device according to (1), further including a second cover member that is disposed apart from the second surface to cover the second surface, and sets a second space between the second surface and the second cover member, in which the second space functions as the evaporator, and the evaporator absorbs heat from the second cover member.

(3) The heat exchanging device according to (1) or (2), in which a partition wall that partitions the first space into an upper space and a lower space located below the upper space is provided on at least one of the first cover member and the first surface, one of the upper space and the lower space functions as the condenser, the other one of the upper space and the lower space functions as the absorber, and the refrigerant and the absorbent is circulated without using external power.

(4) The heat exchanging device according to any one of (1) to (3), in which the plate-shaped structure has a honeycomb structure or a lattice structure, so that the plate-shaped structure has a plurality of hollow spaces extending in one direction and arranged between the first surface and the second surface.

(5) The heat exchanging device according to any one of (1) to (4), further including a heat collector that heats the absorbent based on acquired solar energy, in which a heat collector is disposed in an inside of the plate-shaped structure, and at least one side of the first surface and the first cover member and the second surface or the second cover member has light transmittance.

(6) The heat exchanging device according to any one of (1) to (4), further including a heat collector that heats a heat medium based on acquired external energy and heats the absorbent by heat exchange between the heat medium and the absorbent; and a switching valve that switches a flow channel of the heat medium between a first flow channel and a second flow channel, in which when the flow channel of the heat medium is switched to the first flow channel, the heat medium heats the absorbent by heat exchange between the heat medium and the absorbent, and when the flow channel of the heat medium is switched to the second flow channel, the heat medium is guided to a heat dissipation unit provided on a side of the second surface, a side of the second cover member, or outside without performing heat exchange with the absorbent.

(7) The heat exchanging device according to (5) or (6), in which a differential pressure breaker is provided between the inside of the plate-shaped structure and one of the absorber, the condenser, the evaporator, the regenerator, and a pipe connecting the absorber, the condenser, the evaporator, and the regenerator.

(8) The heat exchanging device according to (6), further including a temperature sensor that detects a temperature in a vicinity of the second cover member, in which the switching valve automatically switches the flow channel of the heat medium to the first flow channel when the temperature detected by the temperature sensor is equal to or more than a predetermined temperature, and automatically switches the flow channel of the heat medium to the second flow channel when the temperature detected by the temperature sensor is less than the predetermined temperature.

(9) The heat exchanging device according to any one of (2) to (8), in which a superhydrophilic film is formed on at least one of a first inner surface that is a surface facing the first space on the first cover member and a second inner surface that is a surface facing the second space on the second cover member.

(10) The heat exchanging device according to any one of (2) to (9), further including a gas barrier layer that covers the plate-shaped structure, the first cover member, the second cover member, and the regenerator in an airtight state to maintain an inside thereof in a vacuum state.

According to the present invention, there is provided a heat exchanging device that can share a wall having pressure resistance and airtightness and can simultaneously realize an increase in the amount of heat dissipation or heat absorption and an increase in the amount of heat collection.

DESCRIPTION OF EMBODIMENTS

Embodiments for carrying out the present invention will be described below with reference to the drawings.

Embodiment 1

Figure 1:
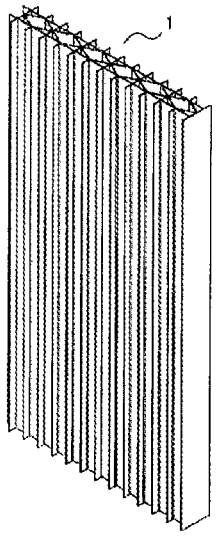
FIG. 1 is a diagram illustrating an extrusion molding material used in a heat exchanging device of the present invention.

A reference number 1 of FIG. 1 is a honeycomb-shaped extrusion molding material in which there are a plurality of chambers partitioned by vertically extruded walls made of a transparent plastic material that is a material constituting the housing of the present invention. It is preferable that the transparent plastic material is a material having high water resistance, high resistance to an aqueous lithium bromide solution, high water vapor resistance, a low water absorption rate, low thermal conductivity, high sunlight transmittance, a continuous use temperature of 100° C. or higher, and high gas barrier properties. Examples of a base resin include polycarbonate, saturated polyester resin, AS resin, cycloolefin polymer, polysulfone, fluororesin, and the like. Examples of such a honeycomb-shaped hollow transparent extrusion-molded product include Lumecapo (a registered trademark) manufactured by Takiron Co., Ltd.

Figure 2:
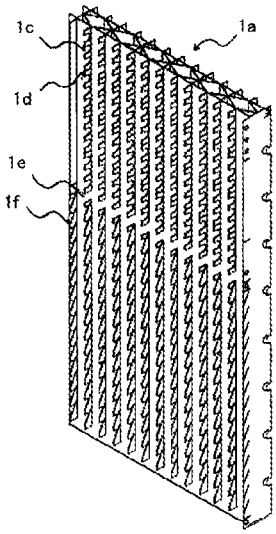
FIG. 2 is a diagram illustrating an outdoor side of a housing used in the heat exchanging device of the present invention.
Figure 3:
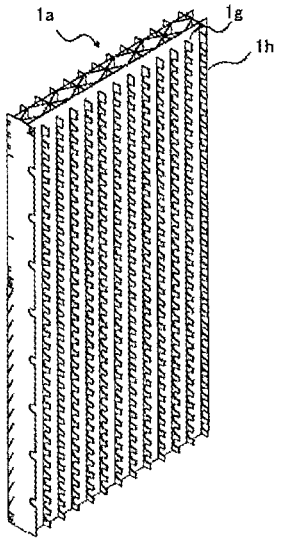
FIG. 3 is a diagram illustrating an indoor side of the housing used in the heat exchanging device of the present invention.

Such an extrusion-molded material is subjected to machining such as notching and drilling as illustrated in FIGS. 2 and 3, to produce a housing 1*a*. FIG. 2 is a diagram illustrating an outdoor side of the housing 1*a*. About a third of an area from an upper side of an outdoor surface is provided with a notch 1*c* that is a lateral passage for water vapor (a refrigerant) required for forming a condenser and a notch 1*d* for forming a transverse partition wall required for forming a water vapor flow channel. About two thirds of an area from a lower side of the outdoor surface is a transverse water vapor passage required for forming an absorber, and is provided with a notch 1*f* for installing a louver-type guide plate, which will be described below, and a notch 1*e* for forming a transverse path that serves as a header for dropping a concentrated absorbent into the absorber. FIG. 3 is a diagram illustrating an indoor side of the housing 1*a*. The entire indoor surface forms an evaporator, and is provided with a notch 1*g* for forming a transverse path serving as a header for dropping water required for that purpose and a notch 1*h* serving as a transverse water vapor passage. A part of the notch 1*h* is also fitted with a heat medium heat dissipation path 6*c* (see FIG. 6).

Figure 4:
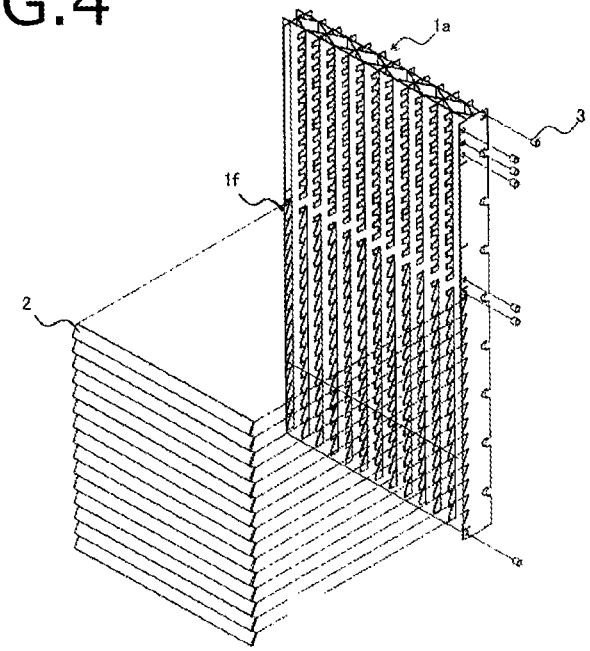
FIG. 4 is a diagram illustrating an assembled state of the housing used in the heat exchanging device.
Figure 5:
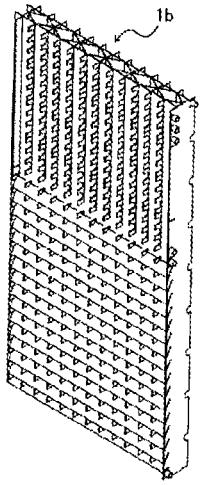
FIG. 5 is a diagram illustrating a state after assembling of the housing used in the heat exchanging device of the present invention.

Further, in this housing 1*a*, as illustrated in FIG. 4, a guide plate 2 for guiding an absorbent flowing down into the absorber is inserted into the notch 1*f*. Further, a nipple 3 for attaching a pipe for the water and the absorbent flowing inward and outward is attached to the housing 1*a*. Although the nipple 3 is bonded or thermally welded to the housing 1*a*, the guide plate 2 needs only to be inserted into the housing 1*a*. The guide plate 2 is made of a transparent plastic material that is the same material as the extrusion molding material 1. FIG. 5 shows the housing 1*b* in a state in which these processes are performed.

Figure 6:
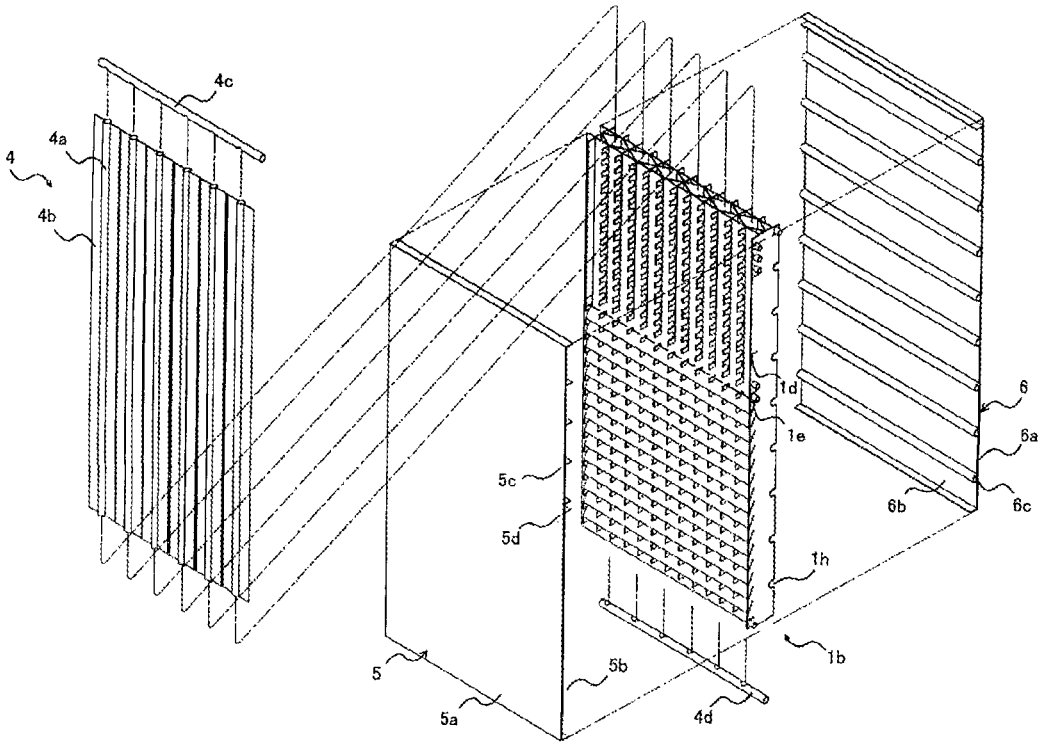
FIG. 6 is a diagram illustrating an assembled state of a transparent heat exchanger package used in the heat exchanging device of the present invention.

A reference number 4 in FIG. 6 shows a heat collector made of an extruded aluminum material. A heat collector 4 is provided with a pipe portion 4*a* serving as a flow channel of a heat medium in a central portion thereof and a heat collecting fin 4*b* that receives sunlight and transmits heat to the heat medium in the pipe portion 4*a*. An outer surface of the heat collector 4 is subjected to sunlight-selective absorption film treatment. A plurality of the heat collectors 4 are inserted and installed into a central section of the housing 1*b*. An upper end thereof is connected to an upper heat medium header 4*c*, and a lower end thereof is connected to a lower heat medium header 4*d*. The inside of the housing 1*b* is maintained in a vacuum state as described later.

An outer wall 5 is bonded or heat-welded to the outdoor side of the housing 1*b*. The outer wall 5 is manufactured by lateral extrusion molding of a transparent plastic material that is substantially the same as the extrusion molding material 1. However, it is preferable that the outer wall 5 has high thermal conductivity. Use of saturated polyester resin, polycarbonate, or the like having a slightly changed material composition and high thermal conductivity grades can be considered. An outer wall device inner surface 5*b* is subjected to superhydrophilic film treatment with a photocatalyst such that the water flowing in the condenser and the absorbent flowing down in the absorber are well wetted and spread on the outer wall 5 and heat is moved. For example, Hydrotect (registered trademark) of TOTO Co., Ltd. is known as such superhydrophilic film treatment, and a transparent polycarbonate daylighting material of Takiron Co., Ltd. is also used.

An outer wall device outer surface 5*a* of the outer wall 5 is in contact with outside air. However, particularly high gas barrier properties are required to maintain vacuum of the entire system of the present invention. Therefore, a thin glass film is affixed to the outer wall device outer surface 5*a*. For example, a product called Lamion (registered trademark) of Nippon Electric Glass is known for bonding such a glass film and polycarbonate. Further, the outer wall device outer surface 5*a* may be increased in surface area by using a glass plate with ribs in order to improve heat dissipation to the atmosphere, and the outer surface of the glass of the outer wall device outer surface 5*a* may be subjected to the superhydrophilic film treatment in order to improve stain-proofing performance.

The outer wall device inner surface 5*b* is provided with a transverse partition wall 5*c* required for forming the water vapor flow channel of the condenser and is fitted with the notch 1*d* of the housing 1*b*. Further, similarly, a transverse partition wall 5*d* that forms a transverse path serving as a header dropping an absorbent of the absorber exists, and is fitted, welded, or bonded to the notch 1*e*. These transverse partition walls 5*c* and 5*d* are formed integrally with the outer wall 5 by transverse extrusion molding.

An indoor wall 6 manufactured by transverse extrusion molding is thermally welded to the indoor side of the housing 1*b*. Although the indoor wall 6 is made of substantially the same transparent plastic material for the purpose of heat welding or bonding to the extrusion molding material 1, the indoor wall 6 is not necessarily transparent. Similar to the outer wall 5, it is preferable that the indoor wall 6 is also manufactured by transverse extrusion molding and has high thermal conductivity. Use of high-temperature-conductivity-grade saturated polyester resin and polycarbonate, of which a material composition is slightly changed, is considered.

An indoor wall device inner surface 6*b* is subjected to the superhydrophilic film treatment such that the water flowing down in the evaporator is well spread and heat transfer is performed efficiently. Since an indoor wall device outer surface 6*a* of the indoor wall 6 is also in contact with the outside air in a house, a particularly high gas barrier property is required to maintain a vacuum state of the entire system of the present invention. Therefore, a thin glass film is affixed also to the indoor wall device outer surface 6*a*. The indoor wall device outer surface 6*a* may be made of glass with ribs in order to increase a heat absorption property from a room, and thus the surface area thereof may increase. The indoor wall device inner surface 6*b* is provided with a heat medium heat dissipation path 6*c* serving as a flow channel through which the heat medium passes when heating of the room is functioned, and the heat medium heat dissipation path 6*c* is fitted, welded, or bonded to the notch 1*h*.

Figure 7:
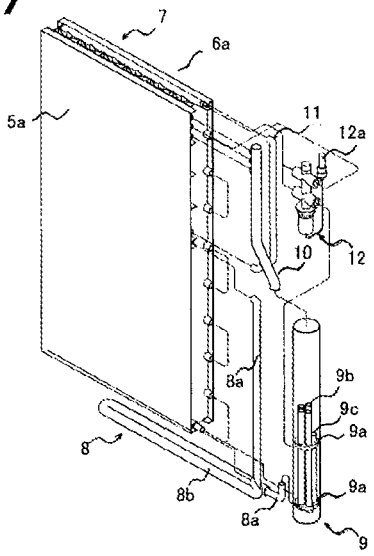
FIG. 7 is a diagram illustrating a state after assembling of the transparent heat exchanger package used in the heat exchanging device of the present invention.

FIG. 7 shows a transparent heat exchanger package 7 completed in this manner. The transparent heat exchanger package 7 is transparent as a whole, and has a structure in which the internal heat collector 4 can be seen although not shown. Although a plurality of flow channel opening portions exist on an end surface of the transparent heat exchanger package 7, the outer wall device outer surface 5*a* and the indoor wall device outer surface 6*a* have high airtightness since glass having gas barrier properties is attached thereto, so that the vacuum state can be maintained. Further, the internal housing 1*b* has a honeycomb shape divided into many cells, and thus can sufficiently withstand the atmospheric pressure applied to the outer wall device outer surface 5*a* and the indoor wall device outer surface 6*a*.

As illustrated in FIG. 7, the transparent heat exchanger package 7 is assembled with the following components so that an absorption air conditioning package constituting a heat exchanging device is completed. The regenerator 9 is not necessarily transparent, but is based on a pressure vessel using a cylindrical extrusion molding material made of the same plastic material as the housing 1*a*. Two partition walls 9*a* exist inside the regenerator 9, and a heat exchange tube 9*b* and a concentrated absorbent tube 9*c* passing through the partition walls 9*a* exist. The heat exchange tube 9*b* requires high thermal conductivity in order to efficiently receive heat of the heat medium in a space partitioned by the two partition walls 9*a* and transmit the heat to the absorbent flowing in the tube, and use of ceramic tube materials such as alumina and silicon carbide is considered. The concentrated absorbent tube 9*c* does not require heat exchange and may be a plastic material.

An absorbent heat exchanger 8 includes an inner cylinder 8*a* and an outer cylinder 8*b* in a counterflow heat exchanger having a double pipe structure. A portion of the inner cylinder 8*a* covered with the outer cylinder 8*b* needs to have high thermal conductivity, and a straight portion may be made of a ceramic tube material such as alumina and silicon carbide. A rising portion of the inner cylinder 8*a*, which is not covered by the outer cylinder 8*b*, does not require heat exchange, and is made of a plastic tube or hose together with the outer cylinder 8*b*. The water vapor flow channel 10 guides the water vapor discharged in the regenerator 9 to the condenser, and is made of a plastic tube or hose. Similarly, a water flow channel 11 is also made of a plastic tube or hose. A self-standing temperature control valve 12 is a direction switching valve that automatically operates according to a degree of temperature expansion of oil exposed to the room temperature in a temperature probe 12*a* that detects the indoor temperature, and is used to switch a flow channel of the heat medium.

Figure 8:
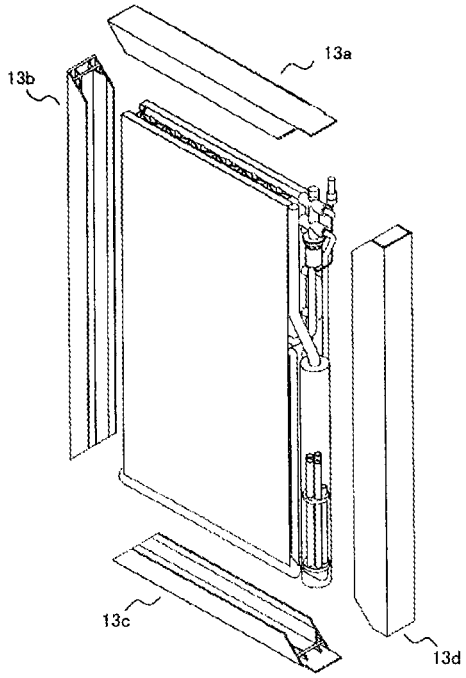
FIG. 8 is a diagram illustrating a state in which an outer frame is attached to the transparent heat exchanger package used in the heat exchanging device of the present invention.
Figure 9:
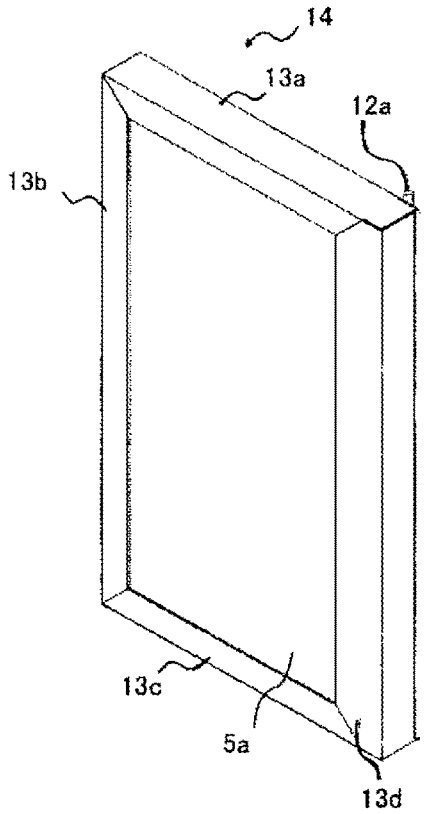
FIG. 9 is a diagram illustrating a state after the outer frame is attached to the transparent heat exchanger package used in the heat exchanging device of the present invention.

After these components are assembled, end portions of the entire transparent heat exchanger package 7 are covered by outer frames 13*a*, 13*d*, 13*c*, and 13*b* as illustrated in FIG. 8, so that a package 14 is completed as illustrated in FIG. 9. The temperature probe 12*a* is installed outside the package 14. The outer frames 13*a*, 13*b*, 13*c*, and 13*d* are not directly in contact with the absorbent, and thus do not need chemical resistance. However, the outer frames 13*a*, 13*b*, 13*c*, and 13*d* require high gas barrier properties to maintain an internal vacuum state, and may be manufactured by aluminum extrusion molding. In this package 14, only the outer wall device outer surface 5*a* made of glass having high gas barrier properties, the indoor wall device outer surface 6*a*, and the outer frames 13*a*, 13*b*, 13*c*, and 13*d* made of aluminum having high gas barrier properties are in contact with the outside air. A flat portion is transparent and the internal heat collector 4 is seen. The internal housing 1*b* withstands an external pressure of 1 atm. The internal regenerator 9 and the condenser are operated at a vacuum of about 1/10 atm, the evaporator and the absorber are operated at a vacuum of about 1/100 atm, and the heat collector 4 is maintained at a lower vacuum level. Therefore, high heat insulation performance is achieved as a whole.

Although components having various degrees of vacuum exist in the package 14, a pressure difference therebetween is at most 1/10 atm or less, so that the internal components only need to have strength enough to withstand such a slight pressure difference. When the outside air enters the package 14 due to some damages or the like, and the vacuum state is damaged, in order to prevent internal components from being damaged by exposure to high pressure differences, a differential pressure breaker is provided between components constituting an absorption refrigeration machine that is a heat exchanging device and an internal space in which the heat collector 4 is accommodated. When the pressure difference exceeding 1/10 atm occurs, a pressure balance valve opens to balance the pressure. Further, the differential pressure breaker will be described below in detail.

Figure 10:
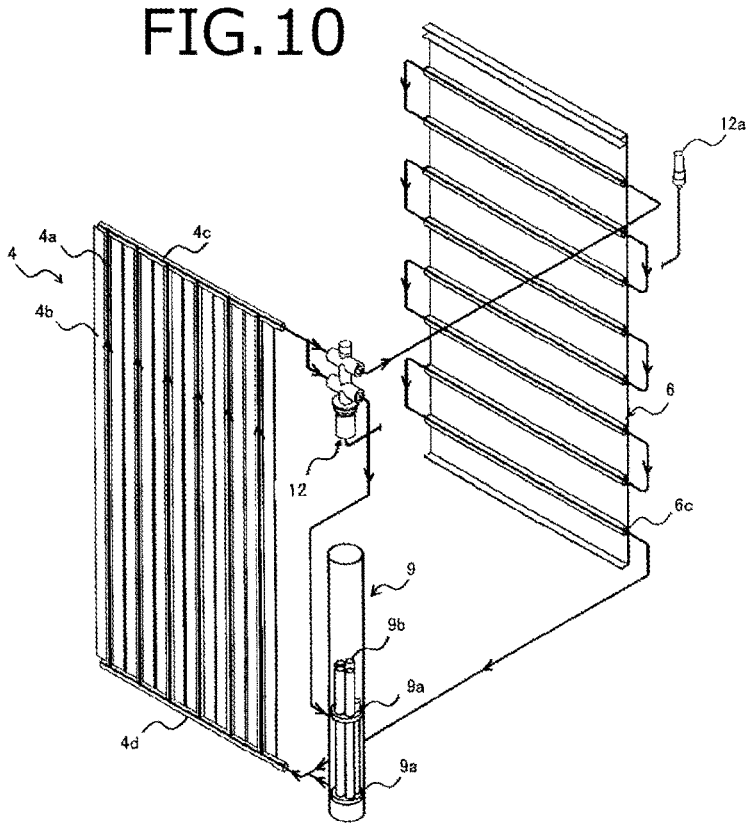
FIG. 10 is a diagram illustrating flow of a heat medium of the heat exchanging device of the present invention.

Flow of the heat medium is illustrated in FIG. 10. In the heat exchanging device of the present embodiment, solar energy is used as external energy. Although about a half of the solar energy is light having a wavelength in the visible light range, the sunlight reaches the heat collector 4 installed in the transparent housing 1*b* through the transparent outer wall 5, and warms the heat medium in the heat collector 4. Since the heat collector 4 is subjected to selective sunlight absorption treatment, a sunlight absorption rate is about 90% or more, so that heat can be efficiently collected. As a result of an increase in the temperature due to the heat collection, the heat collector 4 emits infrared rays. However, since the solar selective absorption treatment is applied, the emissivity of the infrared rays is as low as about 10%, so that heat energy is hardly lost by thermal radiation. Further, since the heat collector 4 is installed in a vacuum state, the heat energy is hardly lost by heat transfer.

The heat medium heated in this manner rises in the pipe portion 4*a* of the heat collector 4 by natural convection, is introduced to the upper heat medium header 4*c*, and is guided to the self-standing temperature control valve 12. When the room temperature is relatively high, the self-standing temperature control valve 12 is operated to guide the heat medium to the regenerator 9 due to the temperature expansion of the oil in the temperature probe 12*a*. The heat medium flows into the room partitioned by the two partition walls 9*a* of the regenerator 9, and warms the absorbent rising inside a heat exchange tube through the heat exchange tube 9*b*. While losing the heat energy, the heat medium itself flows down to the room partitioned by the two partition walls 9*a* of the regenerator 9 by natural convection, is introduced into the lower heat medium header 4*d*, and is guided to the heat collector 4. When the room temperature is relatively low, the self-standing temperature control valve 12 is operated to guide the heat medium to the indoor wall 6 due to temperature contraction of the oil in the temperature probe 12*a*.

The heat medium flows down to the heat medium heat dissipation path 6*c* provided on the indoor wall 6 while releasing heat, flows into the lower heat medium header 4*d*, and is guided to the heat collector 4 again. Although the heat medium is enclosed in the heat medium flow channel at about the atmospheric pressure, it is preferable that the heat medium is always liquid and has low thermal expansion within an operating temperature range from the outside temperature to 100° C. or more. Use of water with an antifreeze added or oil is considered.

When the room temperature is intermediate, a small amount of the heat medium flows to both the regenerator 9 and the heat medium heat dissipation path 6*c* by action of the self-standing temperature control valve 12. As a result, the heating and cooling effect is cancelled out. Further, although not illustrated, the self-standing temperature control valve 12 has a temperature control dial, which can adjust a temperature setting for distributing the heat medium to the regenerator 9 and the heat medium heat dissipation path 6*c*. Such a self-standing temperature control valve 12 is widely used for controlling a heater and a boiler of a hot water radiator set.

Figure 11:
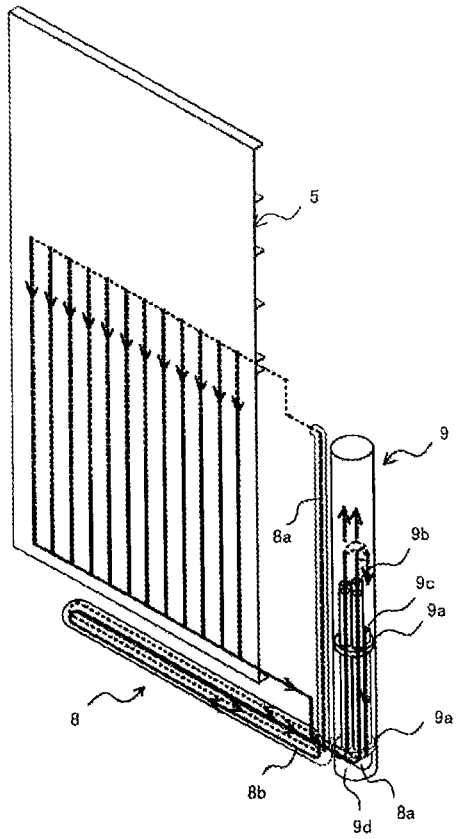
FIG. 11 is a diagram illustrating flow of an absorbent of the heat exchanging device of the present invention.

Flow of the absorbent is illustrated in FIG. 11. The absorption refrigeration machine that is a heat exchanging device may be an ammonia-water system or a water-lithium bromide system. However, in the present invention, since the water-lithium bromide system is adopted, the absorbent is an aqueous lithium bromide solution. As an example, the aqueous lithium bromide solution has a concentration of about 58.5%, and is filled in a lowermost space 9*d* of the regenerator 9 and a lower portion of the heat exchange tube 9*b*.

The pressure of the lower space 9*d* of the regenerator is about 1/100 atm. When a space partitioned by the upper partition wall 9*a* is warmed by the heat medium flowing in from the heat collector 4, the absorbent in the heat exchange tube 9*b* is warmed. When the temperature exceeds about 870° C., the water in the absorbent is boiled. Then, bubbles of the water vapor (the refrigerant) are generated, and rise together with the water vapor inside the heat exchange tube 9*b* due to a bubble lift effect.

The water vapor and a concentrated absorbent, of which the concentration has increased due to a decrease in the water content, are ejected from an upper end of the heat exchange tube 9*b*. As an example, the concentrated absorbent is about 96° C., and the concentration thereof is about 62.5%. The concentrated absorbent, which is separated from the water vapor output from the heat exchange tube 9*b* and loses an air lift effect, flows and falls into the concentrated absorbent tube 9*c*, and flows into the inner cylinder 8*a* of the absorbent heat exchanger 8 that is a counterflow heat exchanger. An outlet of the inner cylinder 8*a* rises and is connected to an upper end of the absorber formed in about 2/3 of portions of the outer wall 5 and the housing 1*b* from the lower side.

When boiling in the heat exchange tube 9*b* is progressed and the pressure of a space at the upper end of the heat exchange tube 9*b* gradually increases, a liquid level of the concentrated absorbent in the rising portion of the inner cylinder 8*a* gradually rises. When the pressure of the space at the upper end of the heat exchange tube 9*b* reaches about 1/10 atm, the concentrated absorbent in the inner cylinder 8*a* flows into the absorber from the inner cylinder 8*a*. Since the pressure is lost due to the pressure in the liquid before the absorbent flows into the absorber, the pressure in the absorber is about 1/100 atm. The concentrated absorbent in the absorber is wetted and spread on the outer wall device inner surface 5*b* of the outer wall 5 subjected to the superhydrophilic film treatment, absorbs the water vapor in the absorber, and flows down while releasing absorbed heat to the outside air through the outer wall 5.

In this way, the absorbent of which the temperature and the concentration are reduced is guided to an annular flow channel between the outer cylinder 8*b* and the inner cylinder 8*a* of the absorbent heat exchanger 8, and flows into the lower space 9*d* of the regenerator again while being preheated by heat exchange with the concentrated absorbent in the inner cylinder. In FIG. 11, a low-concentration absorbent is schematically represented by a solid line, and the concentrated absorbent is schematically represented by a dotted line.

Figure 12:
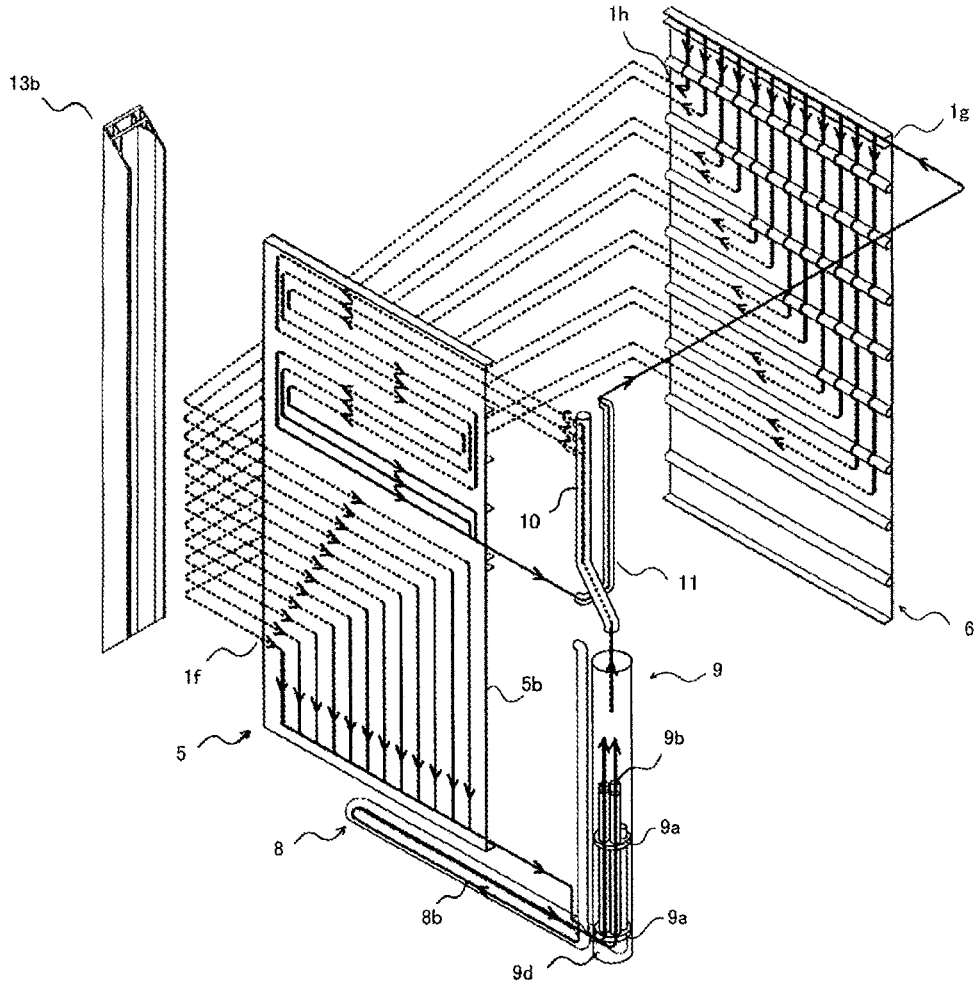
FIG. 12 is a diagram illustrating flow of water of the heat exchanging device of the present invention.

Flow of the water and the water vapor is illustrated in FIG. 12. The flow of the water vapor is schematically represented by a dotted line, and the flow of the water that is a liquid is schematically represented by a solid line. The water, dissolved and absorbed in the absorbent inside the absorber formed in about 2/3 of the portions of the outer wall 5 and the housing 1*b* from the lower side, is guided to the annular flow channel between the outer cylinder 8*b* and the inner cylinder 8*a* of the absorbent exchanger 8 as a part of the absorbent, flows into the lower space 9*d* of the regenerator while being preheated by the heat exchange with the concentrated absorbent in the inner cylinder, and fills the space.

When the space partitioned by the upper partition wall 9*a* is warmed by the heat medium flowing in from the heat collector 4, the absorbent in the heat exchange tube 9*b* is warmed. When the temperature exceeds about 87° C., the water in the absorbent is boiled. Then, bubbles of the water vapor are generated, and rise due to the bubble lift effect while the absorbent inside the heat exchange tube 9*b* is pushed up. When the absorbent is ejected from the upper end of the heat exchange tube 9*b*, the water vapor and the concentrated absorbent of which the concentration is increased due to a decrease in the water content are separated from each other.

The water vapor passes through the water vapor flow channel 10, is guided to an upper portion of the condenser formed at about a third of portions of the outer wall 5 and the housing 1*b* from the upper side, and is condensed while dissipating heat through the outer wall 5. Water droplets is attached to, wets, and is spread on the outer wall device inner surface 5*b* of the outer wall 5 subjected to the superhydrophilic film treatment, flows down in the condenser while being further liquefied, and flows into the water flow channel 11. When the boiling in the regenerator 9 is progressed and the pressure in the space at the upper end of the heat exchange tube 9*b* gradually increases, the liquid level of the water in the water flow channel 11 gradually increases. When the pressure in the space at the upper end of the heat exchange tube 9*b* reaches about 1/10 atm, the water in the water flow channel 11 flows from the inner cylinder 8*a* into the evaporator formed with the indoor wall 6 and the housing 1*b*.

Since the pressure is lost due to the pressure in the liquid before the water flows into the evaporator, the pressure in the evaporator is about 1/100 atm. Since the vapor pressure of the water is about 50 C in this environment, the water is evaporated while wetting, being spread on, and flowing down on the indoor wall device inner surface 6*b* subjected to the superhydrophilic film treatment, and the water takes heat of evaporation from the indoor air through the indoor wall 6 to exhibit a cooling effect.

The generated steam passes through the notch 1*h*, is suctioned into the absorber from the notch 1*f* through a space formed by the outer frame 13*b*, is absorbed and dissolved in the absorbent flowing down into the absorber, becomes a part of the absorbent, passes through the absorbent heat exchanger 8, and travels toward the regenerator 9.

In the heat exchanging device of the present embodiment, external power such as a motor and a pump is not used for circulation of the heat medium, the water vapor as a refrigerant, and the absorbent. Of course, the external power may be used for the circulation of the heat medium, and may further be used for the circulation of the refrigerant and the absorbent.

Figure 13:
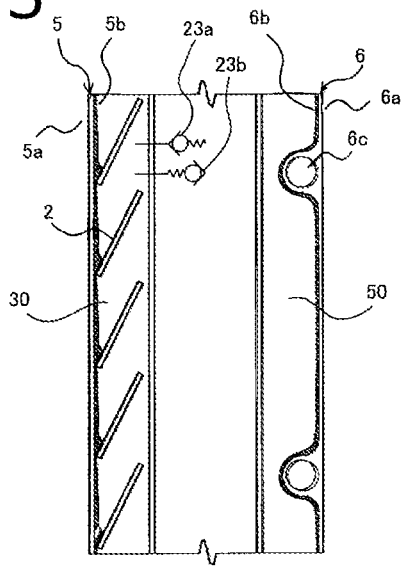
FIG. 13 is a first sectional view of the heat exchanging device of the present invention.

FIG. 13 shows a cross section of a central portion of an absorber 30 and an evaporator 50 of the package 14 during a cooling operation of the heat exchanging device. The guide plate 2 in the absorber 30 is installed to maintain a narrow gap between the guide plate 2 and the outer wall device inner surface 5*b*. The absorbent flowing down into the absorber 30 is guided by the guide plate 2 to be in contact with the outer wall device inner surface 5*b*, wets and is spread on the outer wall device inner surface 5*b* by the superhydrophilic film treatment applied to the outer wall device inner surface 5*b*, and flows down while transferring heat to the outer wall 5 and releasing heat from the outer wall device outer surface 5*a* to the outside air.

Figure 14:
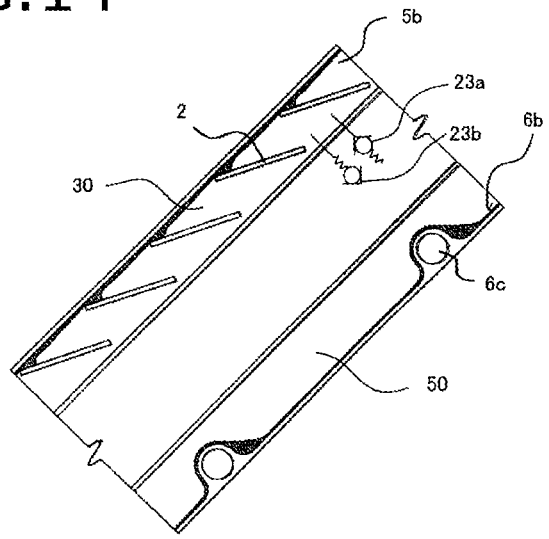
FIG. 14 is a second sectional view of the heat exchanging device of the present invention.

The differential pressure breaker already described may be installed, for example, between the absorber 30 and the inside of a plate-like structure that is a heat collector space. An installation example of the differential pressure breaker is schematically illustrated in FIGS. 13 and 14. A differential pressure breaker 23*a* is set to be conducted when the pressure on the absorber 30 side is higher than the pressure of the heat collector space by 1/100 atm or more, and is set to be closed when the differential pressure becomes 1/100 atm. When the air pressure rises abnormally due to invasion of the atmosphere to an absorption refrigeration machine system including the absorber 30 or the like, gas escapes from the absorber 30 to the heat collector space and functions to balance the pressure. Although FIGS. 13 and 14 show a case where differential pressure breakers 23*a* and 23*b* are installed between the absorber 30 and the inside of the plate-like structure that is the heat collector space, the differential pressure breakers 23*a* and 23*b* may be installed between any one of the condenser (see FIGS. 15A and 15B), the evaporator 50, the regenerator 9, and a pipe connecting them, and the inside of the plate-like structure.

Although FIG. 13 shows a case where the package 14 is vertically installed, the package 14 may be installed inclined as illustrated in FIG. 14. Even in such a case, the guide plate 2 is installed at an angle at which the absorbent can be guided to come into contact with the outer wall device inner surface 5*b*. Meanwhile, even in the case of FIG. 14 where the package 14 is installed inclined, the water flowing down into the evaporator 50 can flow down along the indoor wall device inner surface 6*b* without the guide plate 2.

When the air pressure rises abnormally due to invasion of the atmosphere to the heat collector space or the like, the differential pressure breaker 23*b* escapes gas from the heat collector space into the absorption refrigeration machine system and functions to balance the pressure. Accordingly, the absorbent heat exchanger 8, the regenerator 9, the water vapor flow channel 10, the water flow channel 11, and the like inside a vacuum package are not exposed to the atmospheric pressure or a differential pressure close to the atmospheric pressure, so that a design can be simplified and costs can be reduced.

Further, according to the differential pressure breaker 23*a*, just by inserting the entire body including the heat collector 4 into a transparent vacuum package material 20 (see FIG. 22) and applying a vacuum packaging machine that welds and seals an opening portion of the transparent vacuum package material 20 inside a chamber evacuated to about 1/1000 atm, the inside of the absorption refrigeration machine system including the absorber can be sealed at 1/100 atm. In one process, the vacuum package is completed while a vacuum degree of the absorption refrigeration machine system and a vacuum degree of the heat collector space are properly set. In this case, a vacuum packing process will be described in detail below.

Figure 15A:
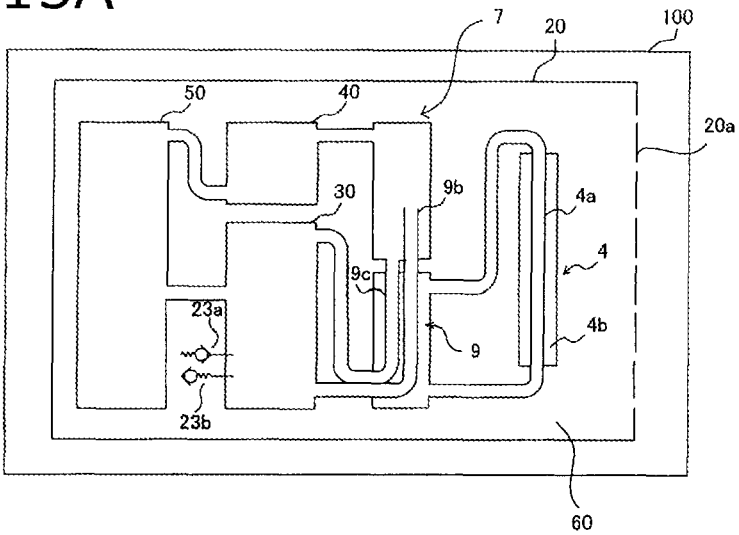
FIGS. 15A and 15B are diagrams for illustrating a vacuum packing process of the heat exchanging device of the present invention.

FIG. 15A schematically shows a state of the inside of a chamber 100 of the vacuum packaging machine that performs vacuum packing. The transparent heat exchanger package 7 assembled as illustrated in FIG. 7 is input to the transparent vacuum package material 20 and is placed inside the chamber 100 of the vacuum packaging machine. When one side of the transparent vacuum package material 20 is opened, and the inside of the chamber 100 of the vacuum packaging machine is gradually reduced in pressure by a vacuum pump of the vacuum packaging machine, the inside of the transparent vacuum package material 20 is also gradually reduced in pressure.

The inside of the plate-like structure including the heat collector 4 communicates with the transparent vacuum package material 20, and the vicinity of the heat collector 4 is also reduced in pressure. However, a flow channel of the heat medium in the pipe portion 4*a* of the heat collector 4 is a closed space, and is maintained at approximately the atmospheric pressure. Although in the absorption refrigeration device including the condenser 40, the absorber 30, the regenerator 9, and the evaporator 50, the pipe connecting them, and the like, the components communicate with each other and have separate closed spaces, a space containing the heat collector 4 communicates with an extra space 60 inside the transparent vacuum package material 20 through the differential pressure breakers 23*a* and 23*b*. When the pressure in the chamber 100 starts to be reduced and the pressure falls below 99/100 atm, the differential pressure breaker 23*a* is opened, the air in the absorption refrigeration device flows into the chamber 100, and the pressure in the absorption refrigeration device starts to be reduced. However, when the differential pressure is about 1/100 atm or less, the differential pressure breaker 23*a* is closed again, and outflow of the air in the absorption refrigeration device is stopped. In this way, during an evacuation process in the chamber 100, the air pressure in the absorption refrigeration device is depressurized following the air pressure in the chamber 100 in a state in which the air pressure in the absorption refrigeration device is higher than the air pressure in the chamber 100 by about 1/100 atm. At a stage where the pressure in the chamber is depressurized to 1/1000 atm, the air pressure in the absorption refrigeration device becomes 1/100 atm, and the differential pressure breaker 23*a* is closed. In this state, an opening portion 20*a* of the transparent vacuum package material 20 is thermally welded. Thus, the vacuum packing process is completed by setting the inside of the absorption refrigeration device to 1/100 atm and setting a space in which the heat collector 4 is stored, that is, the extra space 60 in the transparent vacuum package material 20, to 1/1000 atm.

Figure 27:
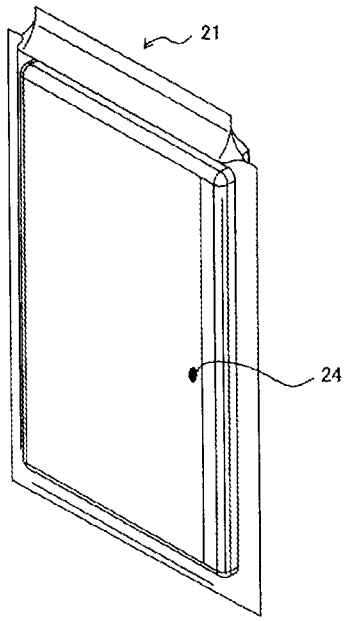
FIG. 27 is a diagram illustrating a state in which a small hole is closed with a transparent vacuum package material of the fourth embodiment of the heat exchanging device of the present invention.

When the differential pressure breakers 23*a* an 23*b* are not used, as illustrated in FIG. 27, a small hole 24 is provided on the surface of the absorber, which is in contact with the transparent vacuum package material 20. At a stage where the inside of the chamber 100 is evacuated to 1/100 atm, the small hole 24 is closed by pressing the heater against the transparent vacuum package material 20 around the small hole 24, and thermally welding the transparent vacuum package material 20. Thereafter, even when the inside of the chamber 100 is further evacuated to 1/1000 atm, and the opening portion 20*a* of the transparent vacuum package material 20 is welded and sealed, the same effect can be obtained. In this case, a vacuum packing process will be described in detail below.

Figure 15B:
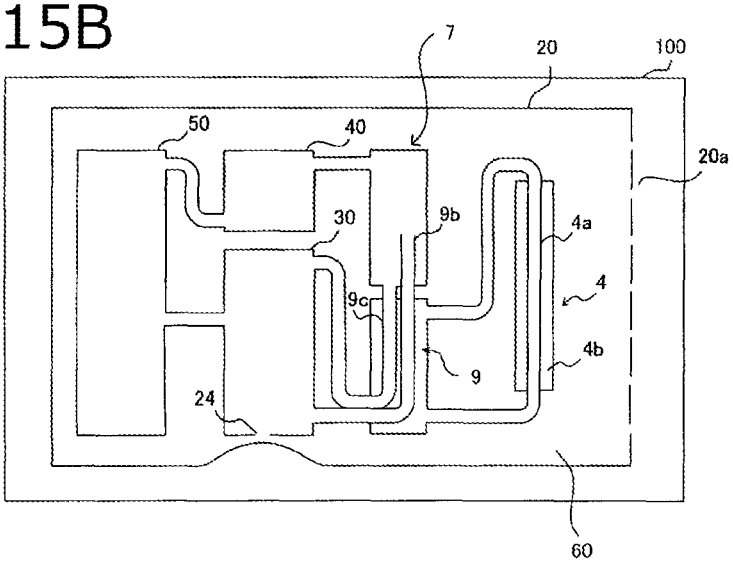

FIG. 15B schematically shows a state of the inside of the chamber of the vacuum packaging machine. Even in this example, in the absorption refrigeration device including the condenser 40, the absorber 30, the regenerator 9, the evaporator 50, the pipe connecting them, and the like, the components communicate with each other, and then have separate closed spaces. However, as described above, the small hole 24 is provided at a portion of the absorber 30, which is in contact with the transparent vacuum package material 20, and communicates with the space in which the heat collector 4 is stored, that is, the extra space 60 inside the transparent vacuum package material 20. When the inside of the chamber 100 starts to be decompressed, the air in the absorption refrigeration device also flows out into the chamber, and decompression in the absorption refrigeration device is progressed simultaneously. When the pressure in the chamber 100 becomes 1/100 atm, the small hole 24 is closed by pressing and heat-welding the heater against the transparent vacuum package material 20 around the small hole 24. Accordingly, the inside of the absorption refrigeration device is sealed at 1/100 atm and is not depressurized thereafter. Further, the pressure in the chamber 100 is reduced, and when the pressure becomes 1/1000 atm, the opening portion 20*a* of the transparent vacuum package material 20 is thermally welded. Thus, the vacuum packing process is completed by setting the inside of the absorption refrigeration device to 1/100 atm and setting a space in which the heat collector 4 is stored, that is, the extra space 60 in the transparent vacuum package material 20, to 1/1000 atm.

Embodiment 2

Figure 16:
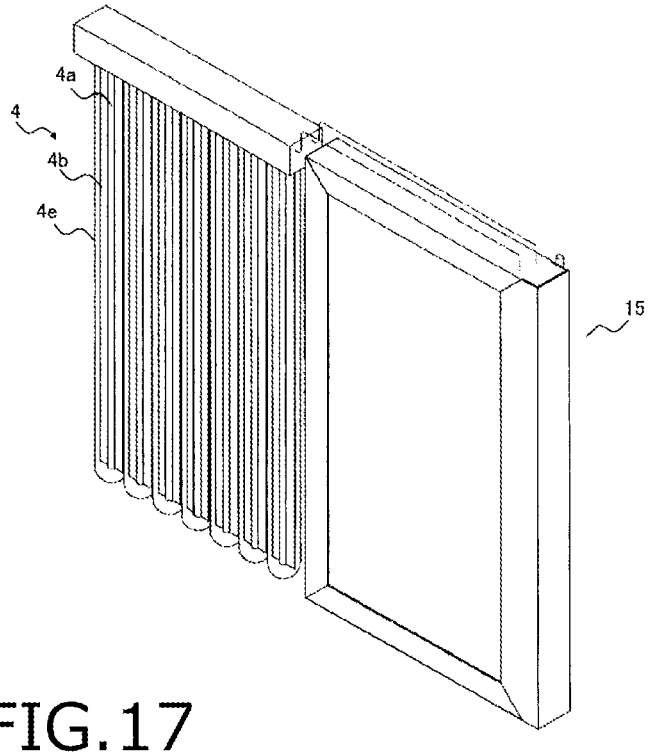
FIG. 16 is a first diagram illustrating a second embodiment of the heat exchanging device of the present invention.
Figure 17:
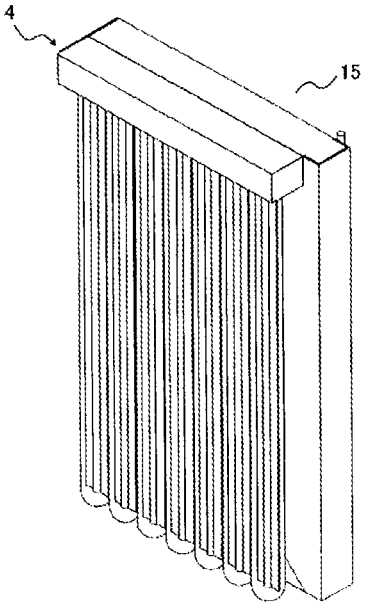
FIG. 17 is a second diagram illustrating a second embodiment of the heat exchanging device of the present invention.

FIG. 16 shows a heat exchanging device according to a second embodiment of the present invention. In the present embodiment, the package 15 of the present invention has the same outer appearance as the package 14 of the first embodiment, but does not include the heat collector 4. A vacuum glass tube type hot water collector, which is already widely used as the heat collector 4, is separately installed and connected. That is, in the heat exchanging device according to the present embodiment, energy of a burner or a heater of the hot water collector is used as external energy. In the present embodiment, the condenser and the absorber of the package 15 of the present invention do not need to be transparent. Further, as illustrated in FIG. 17, the package 15 without the built-in heat collector 4 and the commercial heat collector 4 are installed to overlap each other. Heat of the condenser and the absorber can be dissipated from a gap between the package 15 and the heat collector 4 and a gap of a vacuum glass tube constituting the heat collector 4.

Figure 18:
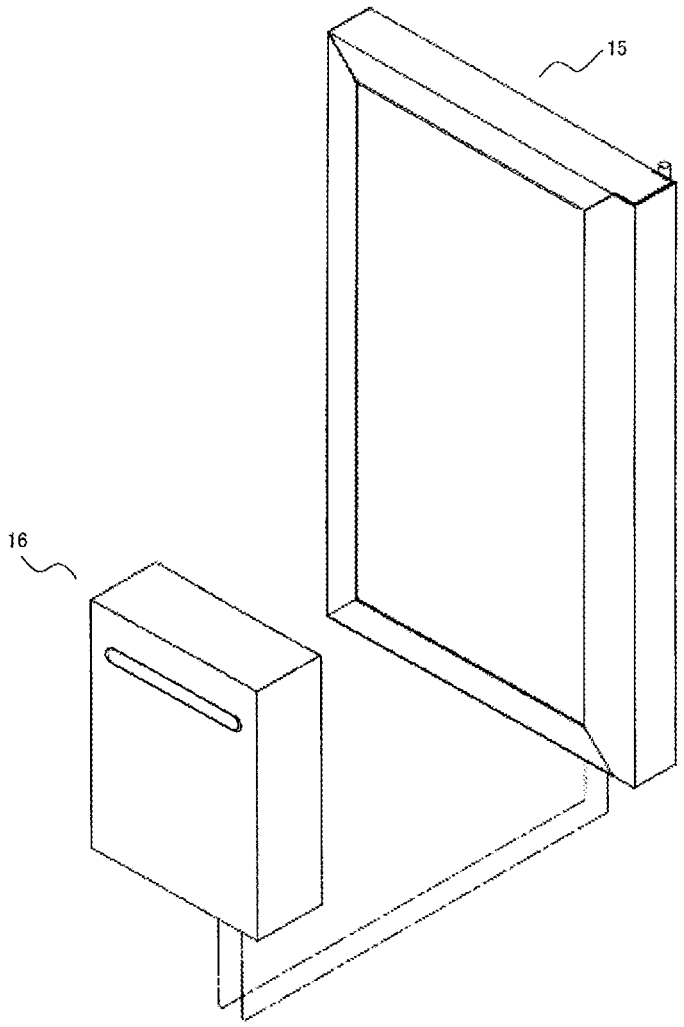
FIG. 18 is a first diagram illustrating a third embodiment of the heat exchanging device of the present invention.

Supply of hot water to the package 15 that does not include the heat collector 4 may be performed from a gas water heater 16 that is widely used as illustrated in FIG. 18. Even in this case, the condenser and the absorber of the package 15 do not need to be transparent, but can be used for a light collecting portion of a building when the components are transparent except for the outer frame 13*a* of the package 15, and the like.

Embodiment 3

Figure 19:
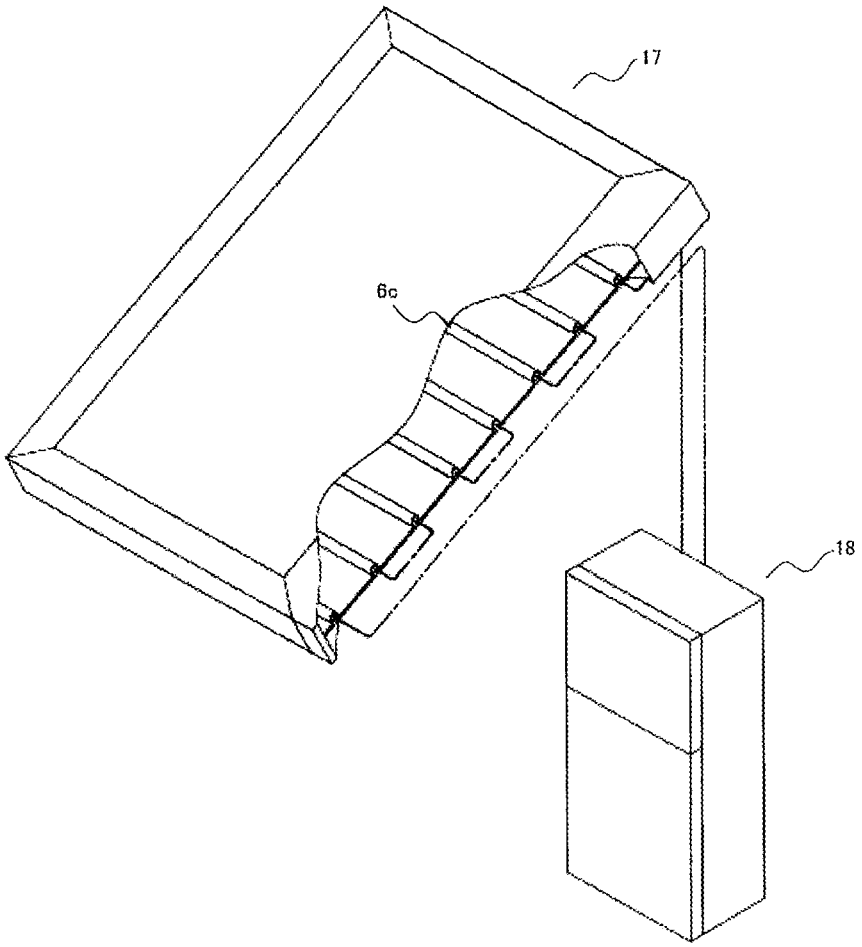
FIG. 19 is a second diagram illustrating a third embodiment of the heat exchanging device of the present invention.
Figure 20:
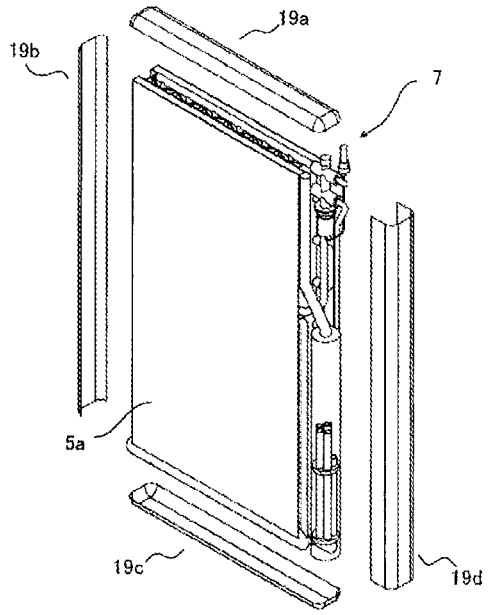
FIG. 20 is a diagram illustrating an assembled state of a package of a fourth embodiment of the heat exchanging device of the present invention.

FIG. 19 shows a heat exchanging device according to a third embodiment of the present invention. In the present embodiment, a package 17 of the present invention has the same outer appearance as the package 14 of the first embodiment, but does not have a heating function and does not include the self-standing temperature control valve 12 or the like. The evaporator has the heat medium heat dissipation path 6*c*. However, here, cold water (brine) instead of the heat medium from the heat collector 4 is introduced into the evaporator. The brine can be extracted to the outside, and can be guided to a device or the like for which an external cooling effect is required.

In an example of FIG. 19, a case where, for example, a roof of an arbor is configured with the main package 17 and a refrigerator 18 is installed therein, but the refrigerator is operated with the brine from the package 17 and is used as a non-electric refrigerator is illustrated. In addition, when such a package 17 is later installed in an existing house, the package 17 can be used when installation as a wall material or a roof material itself is difficult. In a culture farm that cultivates fishery products of specific cold region species, in order to lower the water temperature, a brine pipe may be submerged and used in water.

Embodiment 4

Figure 21:
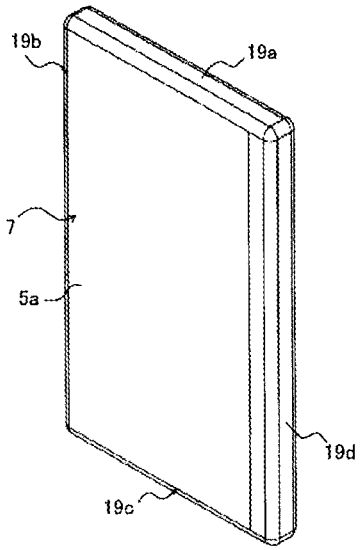
FIG. 21 is a diagram illustrating a state after assembling of the package of the fourth embodiment of the heat exchanging device of the present invention.

A heat exchanging device having a gas barrier layer according to a fourth embodiment of the present invention will be described. As already described, in the heat exchanging device of the present invention, in order to maintain a vacuum state of the entire system, a particularly high gas barrier property is required. Therefore, the gas barrier layer is effective for high gas barrier properties. The gas barrier layer is formed by a vacuum packing technique that is widely used for meat or the like. First, before the outer frames 13*a* to 13*d* illustrated in FIG. 8 are assembled, vacuum packaging is performed on the transparent heat exchanger package 7 assembled as illustrated in FIG. 7. Then, as illustrated in FIG. 19, covers 19*a* to 19*d* for covering sharp corners are attached to the transparent heat exchanger package 7 assembled as illustrated in FIG. 7 so as not to pierce a vacuum pack. FIG. 21 shows a state after the covers 19*a* to 19*d* are attached.

Figure 22:
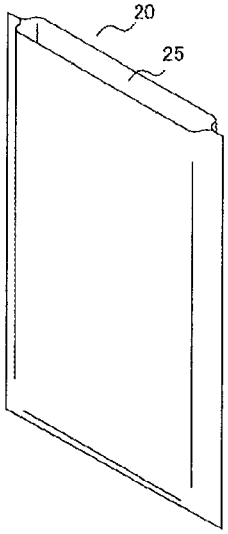
FIG. 22 is a diagram illustrating a transparent vacuum package material of a fourth embodiment of the heat exchanging device of the present invention.

FIG. 22 shows the transparent vacuum package material 20. The transparent vacuum package material 20 is a laminate of a transparent plastic film having a high gas barrier property, and three sides except the upper side are already thermally welded. The inside of the transparent vacuum package material 20 becomes a gas barrier layer 25. The package illustrated in FIG. 21 is inserted into the transparent vacuum package material 20 and is evacuated by applying a vacuum packing machine, and the upper side of the package is welded, so that a vacuum package 21 illustrated in FIG. 23 is completed.

Figure 23:
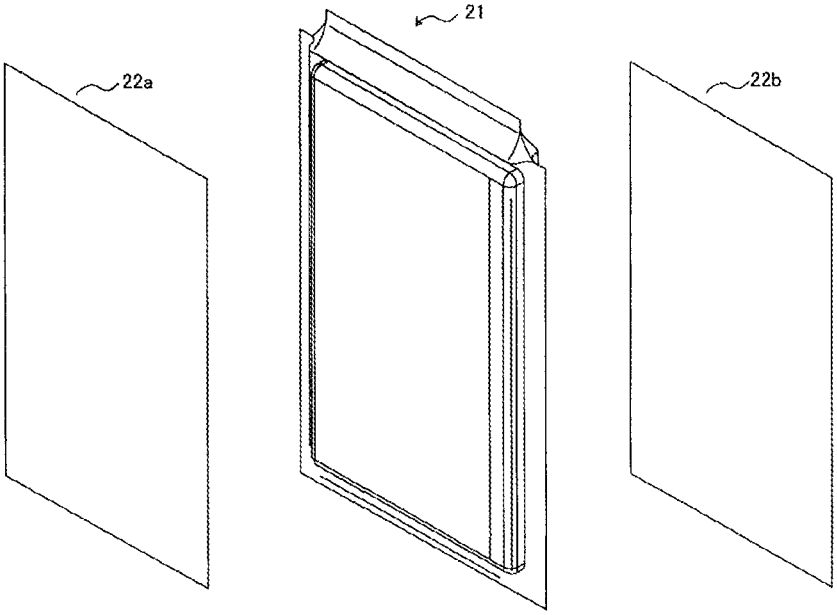
FIG. 23 is a diagram illustrating an assembled state of a vacuum package of the fourth embodiment of the heat exchanging device of the present invention.
Figure 24:
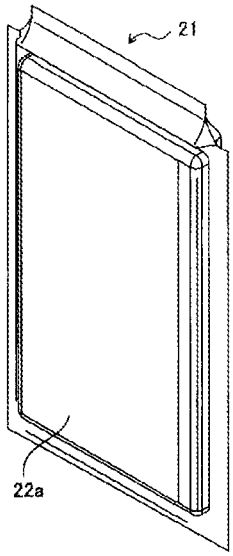
FIG. 24 is a diagram illustrating a state after assembling of the vacuum package of the fourth embodiment of the heat exchanging device of the present invention.
Figure 25:
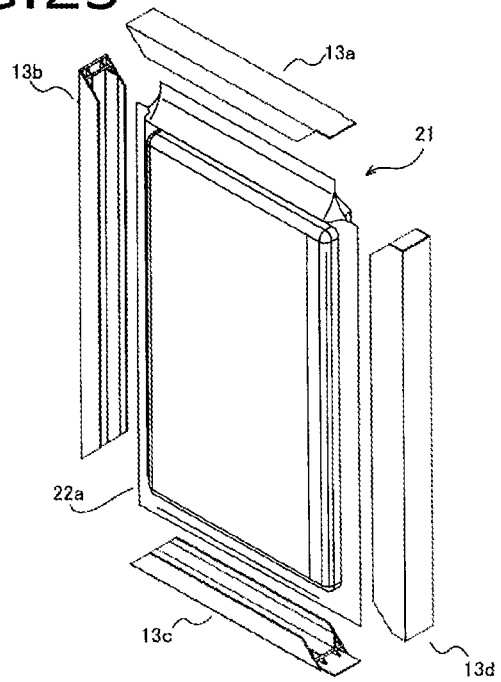
FIG. 25 is a diagram illustrating a state in which the outer frame is attached to the vacuum package of the fourth embodiment of the heat exchanging device of the present invention.
Figure 26:
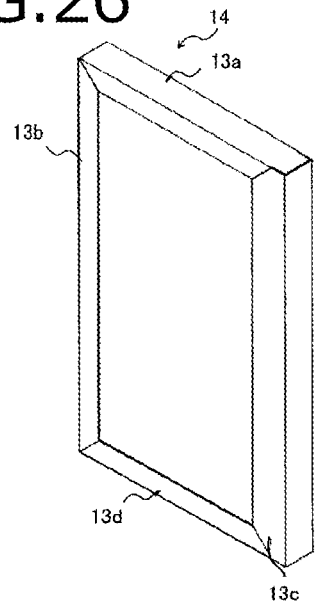
FIG. 26 is a diagram illustrating the package of the fourth embodiment of the heat exchanging device of the present invention.

Further, as illustrated in FIGS. 23 and 24, after the vacuum package 21 is sandwiched between transparent hard plastic sheets 22*a* and 22*b* that protect the transparent vacuum package material 20 that is vulnerable to piercing, the outer frames 13*a* to 13*d* are attached as illustrated in FIG. 25, so that the package 14 is completed as illustrated in FIG. 26. The transparent hard plastic sheet 22*a* on an outdoor side has an ultraviolet absorber added thereto in order to protect the transparent vacuum package material 20 having low weather resistance. The transparent hard plastic sheet 22*b* on an indoor side is not necessarily transparent.

Embodiment 5

A heat exchanger according to a fifth embodiment of the present invention will be described. In any one of the above-described embodiments 1 to 3, the example where the absorption refrigeration device is used for cooling has been described. However, the absorption refrigeration device can be also used for heating.

That is, in embodiments 1 and 2, an embodiment has been described in which the interior is cooled by the transparent exchanger package 7 that absorbs heat from the indoor wall 6 (a second cover member) as heat energy input to the regenerator 9 and dissipates heat from the outer wall 5 (a first cover member). However, reversely, the indoor wall 6 is installed outdoors and the outer wall 5 is installed indoors, so that the transparent exchanger package 7 can be used to heat the interior. In this case, the indoor wall 6 on the outdoor side absorbs heat from the outdoors, and the outer wall 5 on the indoor side dissipates heat indoors. Further, when the transparent exchanger package 7 as in the first embodiments includes the heat collector 4, the indoor wall 6 on the outdoor side of the heat collector 4 needs to have light transmittance.

In embodiment 3, an example where the cold water (the brine) is introduced into the flow channel provided in the evaporator of the indoor wall 6 and the brine is guided to an external heat storage warehouse and is used for the refrigerator has been described. However, similarly, the hot water can be introduced into a flow channel provided in the condenser and the absorber of the outer wall 5 installed on the indoor side, and the hot water can be guided to the external heat storage warehouse and used for a heating cabinet.

What is claimed is:

1. A heat exchanging device comprising:

a regenerator that heats an absorbent by acquired external energy and generates a vapor refrigerant by evaporating a refrigerant from the absorbent;

a condenser that generates a liquid refrigerant by cooling and liquefying the vapor refrigerant generated by the regenerator;

an evaporator that generates a vapor refrigerant by vaporizing the liquid refrigerant generated by the condenser and cools an object by heat of vaporization;

an absorber that absorbs the vapor refrigerant generated by the evaporator into the absorbent;

a plate-shaped structure that has a first surface and a second surface extending two-dimensionally and arranged on a front side and a rear side thereof, respectively, and has a predetermined thickness;

a first cover member that is disposed apart from the first surface to cover the first surface and sets a first space between the first surface and the first cover member; and a second cover member that is disposed apart from the second surface to cover the second surface, and sets a second space between the second surface and the second cover member, wherein only the first space functions as the condenser that dissipate heat from the first cover member and circulates the refrigerant;

only the second space functions as the evaporator, and the evaporator absorbs heat from the second cover member; and the plate-shaped structure has heat insulation performance.

2. The heat exchanging device according to claim 1, wherein a partition wall that partitions the first space into an upper space and a lower space located below the upper space is provided on at least one of the first cover member and the first surface, one of the upper space and the lower space functions as the condenser, and the refrigerant is circulated without using external power.

3. The heat exchanging device according to claim 1, wherein the plate-shaped structure has a honeycomb structure or a lattice structure, so that the plate-shaped structure has a plurality of hollow spaces extending in one direction and arranged between the first surface and the second surface.

4. The heat exchanging device according to claim 1, further comprising:

a heat collector that heats the absorbent based on acquired solar energy, wherein the heat collector is disposed in an inside of the plate-shaped structure, and at least one side of the first surface and the first cover member and the second surface and the second cover member has light transmittance.

5. The heat exchanging device according to claim 1, further comprising:

a heat collector that heats a heat medium based on acquired external energy and heats the absorbent by heat exchange between the heat medium and the absorbent; and a switching valve that switches a flow channel of the heat medium between a first flow channel and a second flow channel, wherein when the flow channel of the heat medium is switched to the first flow channel, the heat medium heats the absorbent by heat exchange between the heat medium and the absorbent, and when the flow channel of the heat medium is switched to the second flow channel, the heat medium is guided to a heat dissipation unit provided on a side of the second surface, a side of the second cover member, or outside without performing heat exchange with the absorbent.

6. The heat exchanging device according to claim 4, wherein a differential pressure breaker is provided between the inside of the plate-shaped structure and one of the absorber, the condenser, the evaporator, the regenerator, and a pipe connecting the absorber, the condenser, the evaporator, and the regenerator.

7. The heat exchanging device according to claim 5, wherein a differential pressure breaker is provided between the inside of the plate-shaped structure and one of the absorber, the condenser, the evaporator, the regenerator, and a pipe connecting the absorber, the condenser, the evaporator, and the regenerator.

8. The heat exchanging device according to claim 5, further comprising:

a temperature sensor that detects a temperature in a vicinity of the second cover member, wherein the switching valve automatically switches the flow channel of the heat medium to the first flow channel when the temperature detected by the temperature sensor is equal to or more than a predetermined temperature, and the switching valve automatically switches the flow channel of the heat medium to the second flow channel when the temperature detected by the temperature sensor is less than the predetermined temperature.

9. The heat exchanging device according to claim 1, wherein a superhydrophilic film is formed on at least one of a first inner surface that is a surface facing the first space on the first cover member and a second inner surface that is a surface facing the second space on the second cover member.

10. The heat exchanging device according to claim 1, further comprising:

a gas barrier layer that covers the plate-shaped structure, the first cover member, the second cover member, and the regenerator in an airtight state to maintain an inside thereof in a vacuum state.

* * * * *